United States Patent [19]

Reiling et al.

[11] 4,420,801

[45] Dec. 13, 1983

[54] REFLECTOR LAMP

[75] Inventors: Gilbert H. Reiling, Chardon; John M. Putz, Twinsburg; David D. Van Horn, East Cleveland, all of Ohio

[73] Assignee: General Electric Company, Schenectady, N.Y.

[21] Appl. No.: 352,741

[22] Filed: Feb. 26, 1982

Related U.S. Application Data

[63] Continuation-in-part of Ser. No. 165,610, Jul. 3, 1980, abandoned.

[51] Int. Cl.[3] ..... F21V 7/00

[52] U.S. Cl. ..... 362/297; 362/307; 362/308; 362/309; 362/310; 362/346; 362/347; 362/375

[58] Field of Search ..... 362/297, 310, 346, 347, 362/350, 375, 307, 308, 309

[56] References Cited

U.S. PATENT DOCUMENTS

| | | | |
|---|---|---|---|
| 981,290 | 1/1911 | Lebby | 362/347 |
| 1,387,424 | 8/1921 | Merritt | 362/347 |
| 1,799,711 | 4/1931 | Varder . | |
| 2,629,046 | 2/1953 | Liberman | 240/103 |
| 3,431,449 | 3/1969 | Hundley | 313/111 |
| 3,443,086 | 5/1969 | Rikis | 362/346 |
| 3,835,342 | 9/1974 | Freeman | 313/114 |
| 3,900,727 | 8/1975 | Hutz | 362/346 |
| 3,944,810 | 3/1976 | Grindle | 362/346 |
| 4,041,344 | 8/1977 | LaGiusa | 313/113 |
| 4,155,110 | 5/1979 | Armstrong et al. | 362/16 |
| 4,218,727 | 8/1980 | Shemitz | 362/346 |

FOREIGN PATENT DOCUMENTS

| | | | |
|---|---|---|---|
| 314545 | 7/1930 | United Kingdom . | |
| 344143 | 3/1931 | United Kingdom . | |
| 344382 | 3/1931 | United Kingdom . | |
| 367053 | 2/1932 | United Kingdom . | |
| 2089956 | 6/1982 | United Kingdom | 362/308 |

OTHER PUBLICATIONS

Elmer, William, 1974, The Optical Design of Reflectors, pp. 210–216.

*Primary Examiner*—Stephen J. Lechert, Jr.
*Assistant Examiner*—Howard J. Locker
*Attorney, Agent, or Firm*—John P. McMahon; Philip L. Schlamp; Fred Jacob

[57] ABSTRACT

A reflector lamp comprising a concave reflector having a parabolic rear section, a spherical intermediate section, and a parabolic front section, each of the reflector sections having substantially the same common focal point, and a finite light source at the substantially common focal point, the reflector sections being dimensioned so that substantially all light rays from the finite light source which are reflected by the spherical intermediate section become re-reflected by the parabolic front section.

7 Claims, 2 Drawing Figures

REFLECTOR LAMP

REFERENCE TO RELATED APPLICATIONS

This application is a continuation-in-part of copending application Ser. No. 165,610 filed July 3, 1980 and now abandoned.

Ser. No. 349,334, filed Feb. 16, 1982 which is a continuation-in-part of copending application Ser. No. 218,932 filed Dec. 22, 1980 and now abandoned.

BACKGROUND OF THE INVENTION

The invention is in the field of optical reflectors and more particularly in the field of reflector lamps.

One general type of reflector lamp comprises a concave reflector having a parabolic contour with respect to a focal point, so as to reflect frontwardly light emitted by a light source located at the focal point. The cross section of the reflector usually is circular, the diameter thereof varying with the distance from the focal point. Additionally, a cone of light rays directly from the light source at the focal point pass, unreflected, through the front of the reflector, the angle of this cone of rays being determined and defined by the front rim of the reflector. The more widely divergent light rays of the cone of rays, i.e. the rays passing relatively nearer to the rim of the reflector, have such a large sideways component of direction so as to fall outside of the desired light pattern and therefore are wasted. The wasted, divergent light can be reduced, and the optical efficiency improved, by making the reflector deeper (longer) so that relatively more of the light is reflected in the desired direction and the cone of non-reflected light is narrowed. However, there are practical limitations on increasing the depth of the reflector, such as cost, weight and awkwardness of use. Also, with a given maximum diameter as the reflector is made deeper, the focal point moves closer to the rear surface, which complicates positioning of the light source and if the light source is a filament there is accelerated blackening of the nearby rear area of the reflector due to evaporation of the filament material (usually tungsten). This accelerated blackening can be alleviated by providing a concave recess at the rear portion of the reflector, which has the drawback of reducing optical efficiency.

Reflectors have been designed having combinations of parabolic and spherical shapes. For example, U.S. Pat. No. 2,629,046 shows a reflector having a parabolic front section, a spherical intermediate section, and a spherical rear section. U.S. Pat. No. 1,799,711 shows an automobile headlamp reflector having a parabolic front section, a spherical intermediate section, and a parabolic rear section, these sections being tilted with respect to each other so as to have different focal points. Other reflector shapes have been proposed, such as an ellipsoidal reflector lamp as is disclosed in U.S. Pat. No. 4,041,344.

SUMMARY OF THE INVENTION

Objects of the invention are to provide a reflector, and reflector lamp, having improved optical efficiency which permits a design having lower power consumption, and to achieve this with a reasonably compact lamp.

The invention comprises, briefly and in a preferred embodiment, a reflector, and a finite light source wherein the reflector has a substantially parabolic front section, a substantially spherical intermediate section, and a substantially parabolic rear section. Each of the reflector sections has substantially the same common focal point and is dimensioned so that substantially all light rays, which are reflected by the spherical intermediate section from a finite light source positioned substantially at the common focal point, are re-reflected by the parabolic front section.

DESCRIPTION OF THE PREFERRED EMBODIMENT

Figure 1:
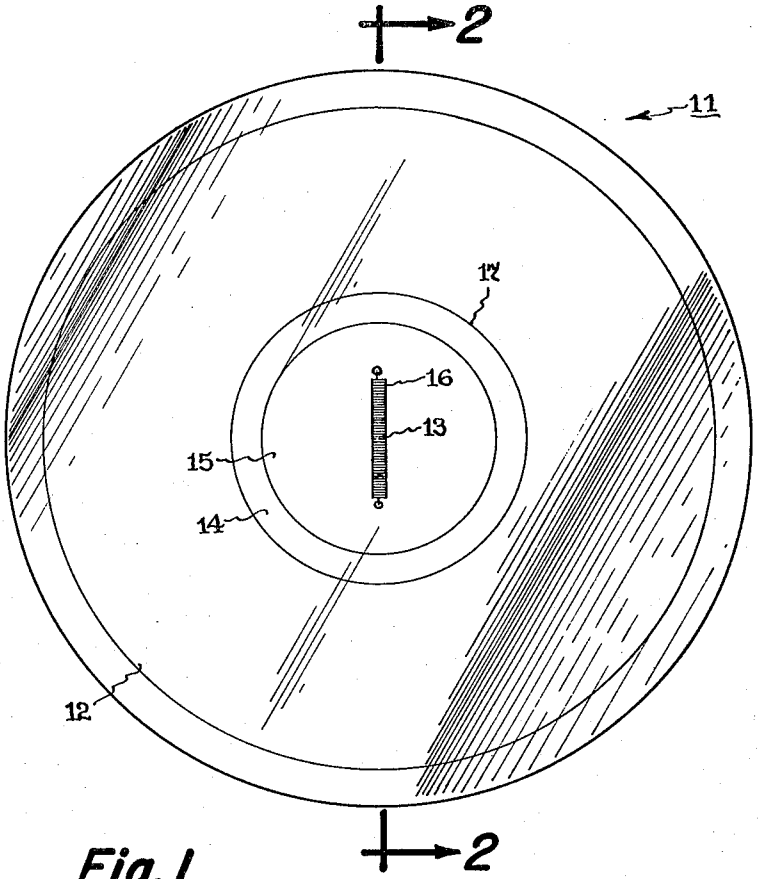
FIG. 1 is a front view of a reflector lamp in accordance with the preferred embodiment of the invention.

A preferred embodiment of the invention, as shown in the drawing, comprises a reflector lamp having a concave reflector 11 shaped to have a front reflector section 12 which has a substantially parabolic contour with respect to a focal point 13, an intermediate reflector section 14 which has a substantially spherical contour with respect to the focal point 13, and a rear reflector section 15 which has a substantially parabolic contour with respect to the focal point 13. The cross section of the reflector 11 in planes perpendicular to its principal optical axis is circular, as shown in FIG. 1. Thus, each of the three reflector sections is defined by a surface of revolution of a parabolic or a circular curve. A finite light source, that is, a light source that is neither infinite nor infinitesimal in size such as a filament 16 is substantially centered at the focal point 13 and generally is either substantially perpendicular to or in the plane of the parabolic front section latus rectum. The latus rectum is defined as the breadth of the front parabolic reflector curve at the focal point 13 and is represented by line 17 in FIG. 2. That is, the light source 16 is located in or near the plane 17 of mutual truncation at the joinder of the front section 12 and intermediate section 14, as shown in the drawing.

Alternative light sources can be employed in place of the filament 16, such as a halogen regenerative-cycle incandescent lamp or an arc discharge lamp. A lens means such as a shaped lens or cover plate 20 may be placed or sealed over the front opening of the reflector 11, to protect the reflecting surface and keep it clean, and/or to modify the light pattern, and is required if the light source is a bare filament 16 in the reflector. The reflector 11 can be made of molded glass, its inner surface being coated with aluminum or silver to provide a reflective surface. Preferably the filament 16 is made of tungsten and is mounted on a pair of lead-in wires 18, 19 of suitable material such as nickel.

Although in the preferred embodiment the focal points of the parabolic and spherical sections are substantially confocal, the focal point of the spherical intermediate section need not be located at substantially the same spatial position as the focal points of the parabolic sections while remaining within the scope of this invention. More specifically, the focal point of the spherical section can be located between the common focal points of the parabolic sections and a point spaced therefrom located not greater than ten times the maximum light source dimension which is perpendicular to the light source major axis. In such an embodiment, the finite light source would be positioned substantially at the common focal points of the parabolic sections.

Similarly, although in the preferred embodiment the finite light source intersects the substantially confocal points of the parabolic and spherical sections and lies in a plane substantially perpendicular to or in the plane of the front parabolic section latus rectum, the finite light source can be located elsewhere while remaining within the scope of this invention. That is, the finite light source can lie in a plane substantially perpendicular or parallel to the front parabolic section latus rectum and located spatially from the substantially confocal points of the parabolic and spherical sections at a distance not greater than ten times the maximum light source dimension which is perpendicular to the light source major axis.

Light rays which emanate from the light source 16 and which strike the parabolic front reflector section 12, will be reflected in a generally frontward direction, as indicated by the light ray path 21. Similarly, light rays emanating from the filament 16 and which strike the parabolic rear reflector section 15, will be reflected generally frontwardly, as indicated by the light ray path 22. A certain relatively small amount of light emanating from the light source 16 is not reflected by the reflector 11, and undesirably emerges through the front opening of the reflector in a divergent beam pattern, as indicated by the light ray path 23. The relative amount of this light depends on how far frontwardly the reflector extends from the focal point.

Figure 2:
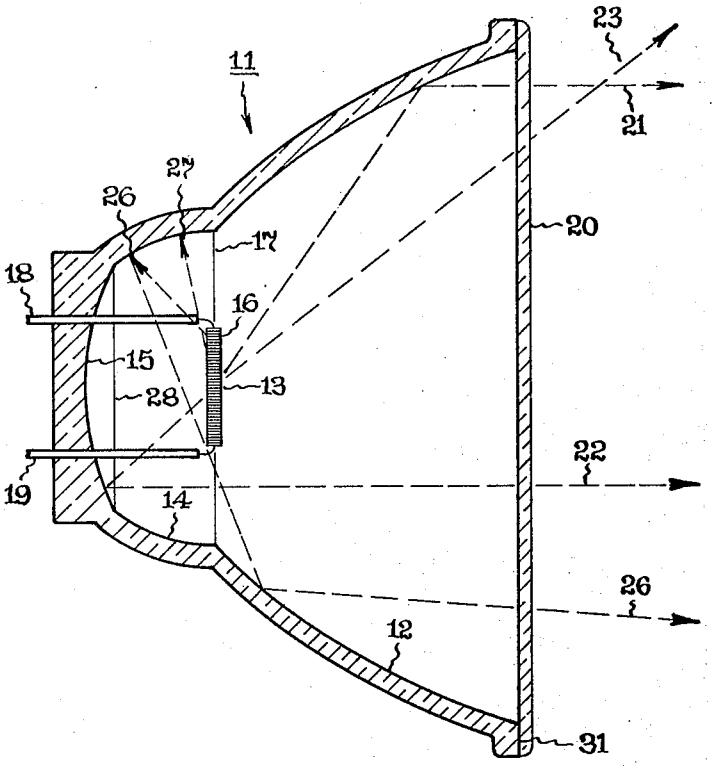
FIG. 2 is a cross section side view taken on the line 2—2 of FIG. 1.

As is disclosed and claimed in the above-referenced patent applications, the spherical intermediate section 14 is dimensioned with respect to the parabolic front reflector section 12 so that substantially all of the light emanating from the light source 16, other than at focal point 13, and which strikes the spherical intermediate section 14, will be reflected thereby in a direction so as to strike the parabolic front section 12 and be re-reflected thereby in a generally frontwardly direction. For example, as illustrated in FIG. 2, a light ray 26 emanating from the light source 16 strikes the intermediate spherical section 14 and is reflected back onto the parabolic front reflector section 12 and is directed frontwardly. As further shown in FIG. 2, the path of light ray 26, as it passes by the reflector rim 31, is not strictly parallel to the paths of reflected light rays 21 and 22. The angles, however, between light ray 26 and light rays 21 and 22, at and beyond the rim 31, are sufficiently small such that light ray 26 is substantially parallel to light rays 21 and 22 thereat and therebeyond and thereby conform to a desired frontward substantially parallel light ray pattern to be provided by the reflector.

It is to be noted that light rays reflected by the intermediate spherical section 14 and which emanate from the light source 16, at focal point 13, will not be reflected in a direction so as to strike the parabolic front section 12. More specifically, and as well known in the art, a ray of light emitted from a light source at a specific wavelength and reflected back onto the light source, at that same wavelength, will either be absorbed and/or re-reflected but will never pass through the light source. For example, any light rays, such as light ray 27, emitted from the portion of the light source 16, located at the focal point 13, striking the intermediate spherical section 14 will be reflected back along the original path of light ray 27, due to the optical geometry thereof, and intercept the light source 16 at focal point 13. Assuming that the light ray 27 maintains the same wavelength throughout its path of travel, then upon intercepting the light source 16, at focal point 13, light ray 27 will be absorbed and/or re-reflected thereby. Light ray 27, will never pass through light source 16. Therefore any light rays emitted from the light source 16, at focal point 13, and which strike the intermediate spherical section 14 and maintain the same wavelength throughout their path of travel, cannot contribute to the total light leaving the lamp 11. In more general terms, and as is well known in the art, any portion of the light source whose reflected image coincides with itself or any other portion of the light source will provide no useful light output inasmuch as the reflected image cannot travel through the actual light source.

A preferred method of designing the reflector, is to first design the front section 12 and then design the contour of the spherical section 14. Next, a line is drawn from the rim 31, and through the focal point 13, to the contour line of the intermediate section 14; this point of intersection establishes the joinder plane 28 at the rear of the section 14 where it joins the rear section 15.

In scientific optical terminology, and as partially described previously, the breadth of the parabolic reflector curve at the focal point 13 is the latus rectum and is represented in the drawing by the line 17 in FIG. 2, and the vertex is the point on the rear surface directly behind the focal point 13. The vertex of the front parabolic section 12 is the point thereon that would be directly behind the focal point 13 if the parabolic curvature were to be continued behind the focal point 13. Thus the focal point 13 is relatively close to the vertex of the front parabolic curve and is substantially farther from the vertex of the rear parabolic curve 15. The diameter of the spherical intermediate section 14 is essentially equal to the length of the latus rectum of the front parabolic curve 12.

The beam coming from the reflector can be further modified by lenses and/or diffusers to achieve a desired light distribution at a specified distance from the lamp such as in a spotlamp or a floodlamp.

Additionally the space defined and surrounded by the spherical intermediate section 14 provides a recess for accommodating the light source 16, and spaces the reflecting surfaces at the back part of the reflector sufficiently far from the filament 16 to minimize blackening thereof by evaporated filament material, and accomplishes this while retaining an optical efficiency substantially as good as if the entire reflector had a single parabolic curvature.

Since the invention provides a reflector construction in which substantially all of the light reflected by the intermediate section is re-reflected in the desired frontward direction by the parabolic front section, and is not "lost" by passing beyond the front face in a divergent pattern, the improved optical efficiency permits construction of a lamp requiring lower watts of power for a given amount of useful light, thus contributing to the nation's goals of fuel economy.

While a preferred embodiment of the invention has been shown and described, various other embodiments and modifications thereof will become apparent to persons skilled in the art, and will fall within the scope of the invention as defined in the following claims.

What we claim as new and desire to secure by Letters Patent of the United States is:

1. A lamp comprising a concave reflector having a front section substantially defined by the surface of revolution of a first parabolic curve whose focal point is relatively close to its vertex with the surface terminating essentially at its latus rectum, an intermediate section of substantially spherical configuration having its center substantially at the focal point of said front section and a diameter essentially equal to the length of said latus rectum, a rear section substantially defined by a surface of revolution of a second parabolic curve whose focal point is substantially farther from its vertex than said first parabolic curve with said two focal points being substantially coincident, and a finite light source positioned substantially at said substantially coincident focal points wherein said rear section terminates at the circular junction with said spherical intermediate section so that substantially all light rays from said light source which are reflected by said spherical intermediate section are re-reflected by said parabolic front section.

2. A lamp as claimed in claim 1 wherein a lens means is attached to the remote edge of said front section.

3. A lamp as claimed in claim 1 wherein said finite light source lies substantially in the plane of said latus rectum.

4. A lamp as claimed in claim 1 wherein said finite light source lies substantially in a plane parallel to the plane of said latus rectum and is located spatially therefrom at a distance not greater than ten times the maximum light source dimension which is perpendicular to the light source major axis.

5. A lamp as claimed in claim 1 wherein said finite light source lies substantially in a plane perpendicular to the plane of said latus rectum and intersects said substantially coincident focal points.

6. A lamp as claimed in claim 1 wherein said finite light source lies substantially in a plane perpendicular to the plane of said latus rectum and is located spatially from said substantially coincident focal points at a distance not greater than ten times the maximum light source dimension which is perpendicular to the light source major axis.

7. A lamp as claimed in claim 1 wherein said center of said spherical section is located between said substantially coincident focal points of said parabolic sections and a point spaced therefrom located not greater than ten times the maximum light source dimension which is perpendicular to the light source major axis.

* * * * *